United States Patent [19]

Berry

[11] Patent Number: 4,499,823

[45] Date of Patent: Feb. 19, 1985

[54] CONTINUOUS PRESS, IN PARTICULAR FOR PRESSING BEET PULP AND OTHER JUICE-CONTAINING MATERIALS

[75] Inventor: Jean-Luc Berry, Compiegne, France

[73] Assignee: S.I.C.A. Pulposec de Chevrieres, Compiegne, France

[21] Appl. No.: 495,778

[22] Filed: May 18, 1983

[30] Foreign Application Priority Data

May 24, 1982 [FR] France ..... 82 08962

[51] Int. Cl.[3] ..... B30B 9/20

[52] U.S. Cl. ..... 100/121; 100/157

[58] Field of Search ..... 100/157, 177, 121, 174, 100/90; 68/98

[56] References Cited

U.S. PATENT DOCUMENTS

| | | | |
|---|---|---|---|
| 390,651 | 10/1888 | Crawford | 100/157 X |
| 3,015,199 | 1/1962 | McKeon et al. | 100/157 X |
| 3,086,454 | 4/1963 | Asplund | 100/157 X |
| 3,234,894 | 2/1966 | Dechert | 100/905 |

FOREIGN PATENT DOCUMENTS

| | | |
|---|---|---|
| 579424 | 8/1924 | France . |
| 592105 | 4/1925 | France . |
| 857925 | 4/1940 | France . |
| 2469273 | 5/1981 | France . |
| 29392 | 5/1981 | France . |

*Primary Examiner*—Peter Feldman

*Attorney, Agent, or Firm*—Schwartz, Jeffery, Schwaab, Mack, Blumenthal & Koch

[57] ABSTRACT

The present invention relates to a continuous press for pressing beet pulp and other juice-containing materials, and comprising a wheel (10, 12) which rotates about its own axis inside an eccentric rotatable ring (16) which is pressed against the wheel, and which has an inside diameter larger than the outside diameter of the wheel. The axial ends of a pressure region are closed by cheek plates (48) in the form of rings of smaller diameter than the wheel. These plates are pressed against the inside surface of a wheel rim (12) by pressure wheels (58). They prevent material from escaping from the pressing region, but being of small diameter, they allow material to be inserted and removed from the wheel-ring assembly up and downstream respectively from the pressing region.

13 Claims, 6 Drawing Figures

CONTINUOUS PRESS, IN PARTICULAR FOR PRESSING BEET PULP AND OTHER JUICE-CONTAINING MATERIALS

The present invention relates to a continuous press, in particular one for pressing beet pulp and other juice-containing materials such as green fodder in order to recover the juice from said materials or else to increase the proportion of dry matter in the final product.

BACKGROUND OF THE INVENTION

French Pat. No. 2 469 273 describes such a press which comprises a central wheel fixed on a rotating shaft driven at a slow speed and rotating inside an eccentric rotating ring having an inside diameter which is larger than the outside diameter of the wheel, thereby constituting a rotary assembly of two cylinders which meet tangentially internally. The outer ring is thrust radially against the outside surface of the wheel by a thrust device which, for example, may comprise rollers mounted on a bogie which is thrust against the outside surface of the ring by a jack or the like which connects the bogie to the wheel's drive shaft. One of the pressure surfaces, e.g. the inside surface of the ring, is perforated to extract the juice.

When it is desired to use a press of this type for pressing a material such as beet pulp which is both slippery and highly deformable and which has substantially no strength in shear or in tension, several major difficulties are encountered. In particular, once the material between the wheel and the ring is subjected to a relatively low pressure, the pulp is extruded through the perforations in the inside surface of the ring, and the perforations rapidly become clogged. Also, considerable flow is observed in the material which escapes sideways from the region of pressure between the wheel and the ring, and is thus not properly pressed. Further, the slippery and sometimes even slimy structure of the pulp limits the transmission of rotating force from the wheel to the ring, which is thus not properly driven.

Beet pulp is a by-product of the sugar extraction process applied in a sugar works to sugar-beet cossettes. The residual pulp is essentially constituted by water, and contains only about 6% by weight dry matter.

When this pulp is fed immediately to animals, it is usually subjected to an initial pressing operattion to bring the dry matter content up to about 10%. If the pulp is to be made into silage for winter storage, it is necessary to proceed with a second pressing operation to obtain about 20% dry matter content. When the pulp is to be transported or included in animal feed concentrates, the dry matter content must be raised to about 85%, which is usually done in two stages: a first stage which consists in tightening up the second pressing operation to obtain up to 25% dry matter on average; and a second stage consisting in dehydration by heating in a drier which is heated by burning heating fuel. The energy expended in this second stage is very expensive.

Preferred embodiments of the present invention enable said expense to be considerably reduced by increasing the dry matter content of the material to be dehydrated. This is done by a particularly effective pressing operation.

SUMMARY OF THE INVENTION

The present invention provides a continuous press, in particular for pressing beet pulp and other juice-containing materials, the press comprising:

a rotatable rimmed wheel;

a rotatable ring having an inside diameter which is greater than the outside diameter of the rimmed wheel, the ring surrounding the wheel and being eccentrically mounted relative thereto;

thrust means for urging the wheel rim against the inside surface of the ring in a pressing region;

means for inserting material to be pressed between the wheel rim and the surrounding ring upstream from the pressing region, and means for removing pressed material downstream therefrom;

the improvement wherein:

the axial ends of the pressing region are closed by respective cheek plates, with each cheek plate being circular, of smaller diameter than the outside diameter of the wheel, and pressed in a substantially material-tight manner against a corresponding one of the axial end faces of the ring, in such a manner as to leave axial access to the space between the wheel rim and the surrounding ring at points distant from the pressing region whereby material to be pressed may be inserted, and pressed material may be removed, said cheek plates being rotatably mounted about an axis which is parallel to the wheel's axis of rotation and which is fixed relative thereto.

The provision of cheek plates closing the axial ends of the pressing region between the wheel and the ring make it possible to greatly increase the pressure applied to the material in said region, even when the material is very slippery and highly deformable, as is sugar beet pulp.

A press in accordance with the invention is capable of obtaining pressed material with a dry matter content of about 32% to 35% by weight, as compared with the best conventional presses available on the market which do not provide better than about 26% dry matter content.

As a result, a subsequent dehydration step may show a fuel saving of as much as 40%.

Preferably, the substantially cylindrical inside surface of the ring comprises a first perforated sheet having relatively small holes, a filter cloth covering said first perforated sheet on its surface facing the rim of the wheel, and a second perforated sheet having larger holes than the first perforated sheet and pressing said cloth against said first perforated sheet, the axial edges of said sheets being folded over the edges of the ring and received in recesses in the axial end faces of the ring.

This arrangement of a filter cloth sandwiched between a perforated sheet having large holes and a perforated sheet having small holes prevents the small holes of the first perforated sheet from becoming clogged with pressed material, while the second perforated sheet protects the filter cloth from rapid destruction.

It is also desirable for the wheel drive shaft to be supported on at least one rigid lever having one end hinged to a rigid press-supporting structure about a first axis parallel to the wheel axis, and having its other end connected via thrust means such as a jack to a second fixed axis on said rigid structure, said ring being supported via its outside surface by rollers mounted on at least one bogie which is fixed to said fixed supporting structure about a third axis parallel to the wheel axis.

With this arrangement, the press-supporting structure supports the wheel and ring assembly as well as the bogie(s) for applying thrust via the rollers to the outside surface of the ring.

BRIEF DESCRIPTION OF THE DRAWINGS

An embodiment of the invention is described by way of example with reference to the accompanying drawings, in which.

MORE DETAILED DESCRIPTION

Figure 1:
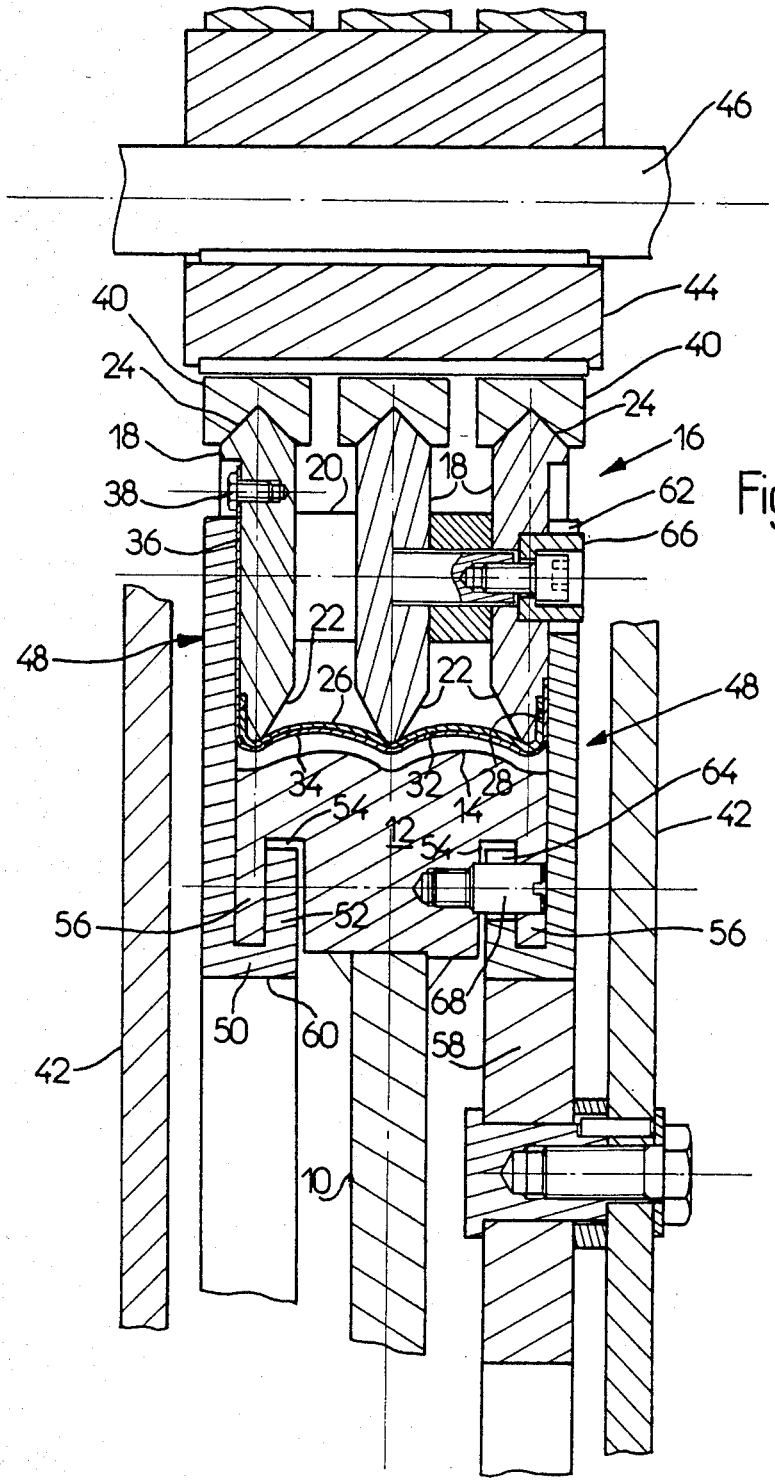
FIG. 1 is a diagrammatic axial section through a portion of a press in accordance with the invention.
Figure 2:
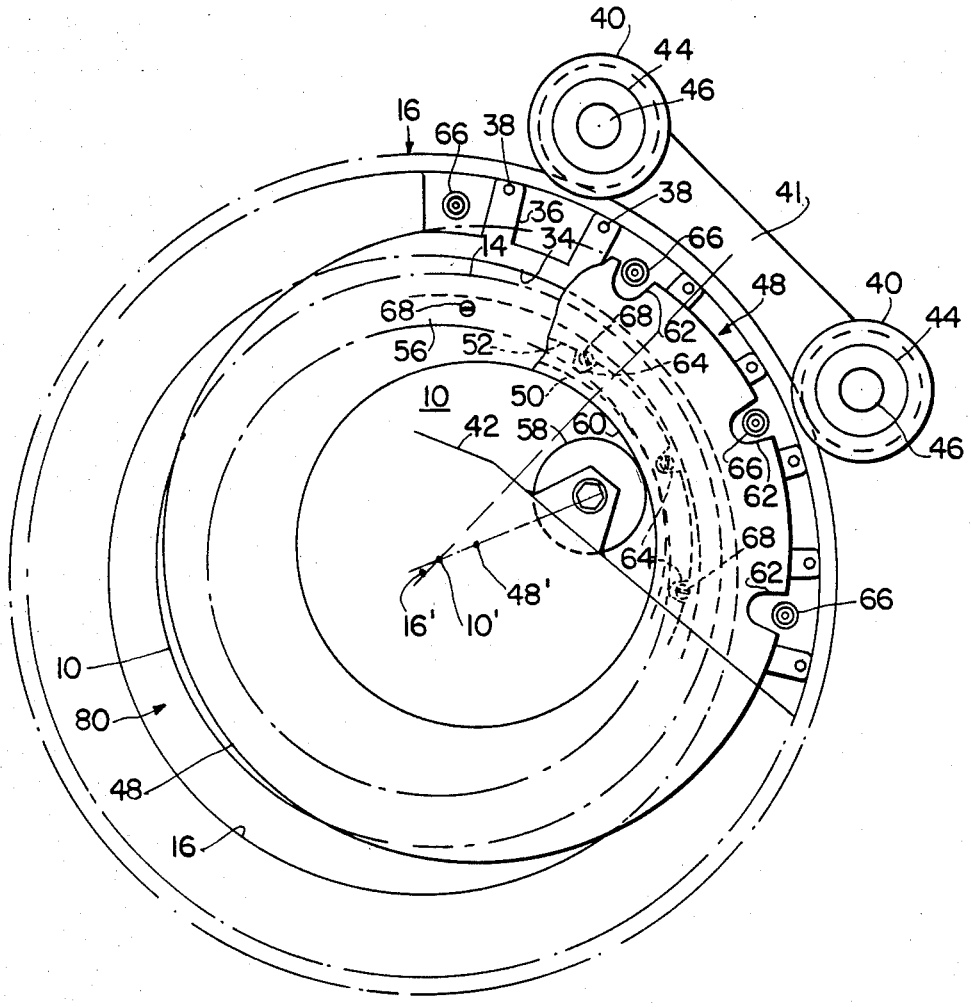
FIG. 2 is a side view of the portion of the press shown in FIG. 1.

Reference is made initially to FIGS. 1 and 2 which show a portion of a press in accordance with the invention.

The press comprises a wheel 10 having an outer rim 12 whose generally cylindrical outer surface 14 is corrugated, as can be seen in FIG. 1.

The wheel 10 rotates about an axis 10 on a shaft, not shown, inside an excentric ring assembly numeral 16 which is essentially constituted by a stack of three substantially identical component rings 18 which are equally spaced along a common axis numeral 16 and which are rigidly connected to one another by spacers 20. Other, like means could be used to hold the component rings together, or indeed they could be formed in a single piece. The component rings 18 are substantially flat with bevelled inside and outside edges 22 and 24 respectively.

The inside surface of the ring assembly is made up as follows: a first perforated sheet 26 which has relatively small holes and which is corrugated in shape to match the outer surface 14 of the wheel rim, covers the inside edges 22 of the component rings 18. The axially outer edges of the first perforated sheet 26 are turned radially outwardly to constitute lips 28 which are received in recesses formed in the end faces of the end component ring 18 and which are fixed therein, e.g. by welding. A filter cloth 32 is placed directly over the first perforated sheet 26 and is folded radially outwardly over the lips 28 thereof. A second perforated sheet 34 having holes of much larger diameter than the first sheet 26, but otherwise of substantially the same shape is placed over the filter cloth 32 and is releasably fixed to the end faces of the end component rings 18. For this purpose, the outwardly turned lips of the second perforated sheet 34 have a series of angularly spaced radially projecting tabs 36 which are received in corresponding recesses in the end faces of the end component rings 18, and which are fixed therein by screws 38 located near to the outer periphery of said end faces.

Advantageously, the second perforated sheet 34 is not made in a single piece, but comprises a plurality of segments placed end-to-end. The filter cloth 32 may also be constituted by a plurality of pieces fixed directly to the segments of the second perforated sheet 34, thereby enabling a defective portion of the cloth to be rapidly replaced without having to replace the entire cloth.

The device for thrusting the wheel against the ring assembly thus constituted is of the type described in above-mentioned French Pat. No. 2 469 273, and comprises a bogie 41 having two sets each of three roller wheels 40. The bogie 41 is connected by a bar and thrust means such as a jack (not shown) to a bar 42 which also supports the drive shaft of the wheel 10. The roller wheels 40 are keyed to two hubs 44 so as to be constituted to rotate with the hubs while being left free to move axially therealong. Each hub 44 is likewise keyed to a corresponding shaft 46 which may be free or which may be a drive shaft. The outside surfaces of the roller wheels 40 have annular grooves of section complementary to the bevelled outside edges of the component rings 18. The fact that each roller wheel 40 is free to move axially along its hub means that the roller wheels 40 take up accurately fitted positions on the respective component rings 18, thereby enabling large compression and drive forces to be transmitted thereto without deformation.

The pressing region in which material is compressed is formed by the quasi-tangential line between the central wheel and the surrounding ring assembly, and the region immediately upstream therefrom. The axial ends of the pressing region are closed by annular cheek plates 48 which rotate about an axis 48' and are held and pressed against the end faces of the end component rings 18 of the ring assembly 16. For this purpose, each of the cheek plates 48 has a cylindrical hub 50 directed towards the center of the press and terminated by an annular flange 52 extending radially outwardly, thus leaving an annular groove of rectangular cross section between the annular flange 52 and the remainder of the cheek plate 48.

The inside surface of the rim 12 of the wheel 10 has two annular grooves 54 forming, together with the axial end faces of the rim 12, respective annular flanges 56 extending radially inwardly and adapted to engage in said annular grooves of the cheek plates 48 and to abut against the bottoms thereof.

On the bars 42 which support the drive shaft of the wheel 10, there are idler wheels 58 mounted to rotate about axes parallel to the shaft of the wheel 10, and which are disposed to bear against the inside cylindrical surfaces 60 of the hubs 50 of the cheek plates 48 in order to keep the flanges 52 inside the grooves 54 in the vicinity of the region where the space between the wheel and the adjacent ring assembly is of minimum thickness, i.e. in the vicinity of the pressing region. Thus, the end faces of the ring assembly 16 are maximally covered by the annular cheek plates 48 in the pressing region, but since the cheek plates 48 are of smaller diameter than the wheel 10, they leave a large area of empty space numeral 80 (FIG. 2) between the wheel and the ring assembly in the region diametrically opposite to the pressing region. This empty space is used for inserting material to be pressed and for extracting pressed material.

The cheek pieces 48 can be pressed without difficulty against the outside end faces of the end rings 18 in the ring assembly 16 because the folded back lips of the perforated sheets 26 and 34 are received in recesses in said end faces, thereby leaving plane bearing surfaces on the end faces free from any projecting portion of perforated sheet. The cheek pieces can thus be pressed and sealed against the end faces of the ring assembly.

When the wheel 10 is rotated inside the ring assembly 16, the annular cheek plates 48 are driven by the wheel in rotation about an axis which is fixed relative to the bars 42 and hence to the axis about which the wheel 10 is rotating. To avoid unwanted sliding between the annular cheek plates 48 and the end faces of the wheel rim and the ring assembly, radial notches 62 may be provided, as shown in FIGS. 1 and 2, around the outer periphery of the annular cheek plates 48, and/or radial notches 64 may be provided in the periphery of the cheek plate channel section rims 52. The radial notches 62 and 64 form teeth for engaging cups 66 which are screwed onto the end faces of the ring assembly or pegs 68 passing across the annular grooves 54 in the rim 12. The cheek plates 48 are thus positively driven in continuous rotation.

Alternatively, the cheek plates could be driven independently, e.g. by a variable speed motor.

Figure 3:
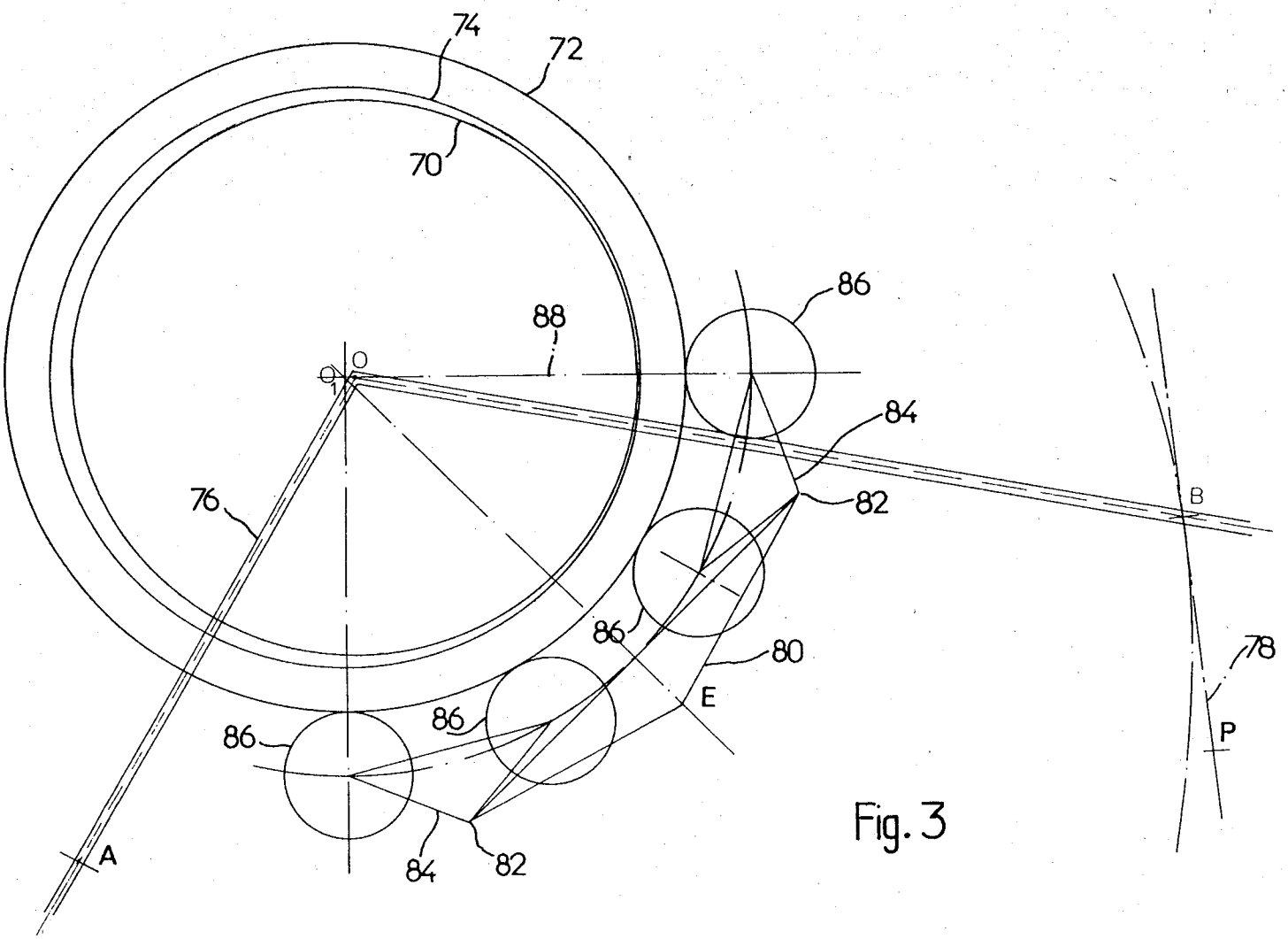
FIG. 3 is a geometrical diagram showing how the wheel, the ring and the roller-bearing bogies are disposed relative to a fixed supporting structure.

Reference is now made to FIG. 3 which shows the geometrical disposition of the parts described above.

In this figure, the wheel is represented by a circle 70 of center 0, and the ring is represented by concentric circles 72 and 74 having a center $0_1$. The drive shaft for the wheel 70 is carried on at least one rigid lever 76, which is angled at the wheel axis 0, and which has one end hinged about an axis A on a fixed structure of the press while its other end is connected to a point P on said fixed structure via a jack or other thrust means 78 which is hinged to the lever 76 about an axis B and to the fixed structure about an axis P. All three axes A, B and P are parallel to the rotation axis of the wheel.

A bogie 80 is hinged about an axis E to the fixed structure. The axis E is again parallel to the wheel rotation axis. At its ends 82 the bogie 80 carries two smaller bogies 84 each of which carries two sets of rollers 86, with the sets of rollers being arranged in the same way as shown in FIGS. 1 and 2 for the rollers 40 on the bogie 41.

The outside peripheral face 72 of the ring assembly is pressed against and supported by the rollers 86.

It will be appreciated, that by suitably adjusting the jack 78 or equivalent means, the wheel 70 can be brought up towards the inside surface 74 of the ring assembly, with the region of least cross section, i.e. the pressing region, being substantially on the horizontal straight lines 88 passing through the rotation axis 0 of the wheel 70 and the rotation axis of the uppermost set of rollers 86 (uppermost being relative to the orientation shown in FIG. 3).

In some applications, e.g. depending on the nature of the material to be pressed, it can be advantageous to modify the inclination of the straight line 88 so that it is at some significant angle to the horizontal. This can be done by modifying the length of the lever arm 76 between the axis 0 and the point A, thereby causing the various components of the press to be moved or tilted somewhat, while leaving the axes A, E and P fixed relative to the fixed structure.

Figure 4:
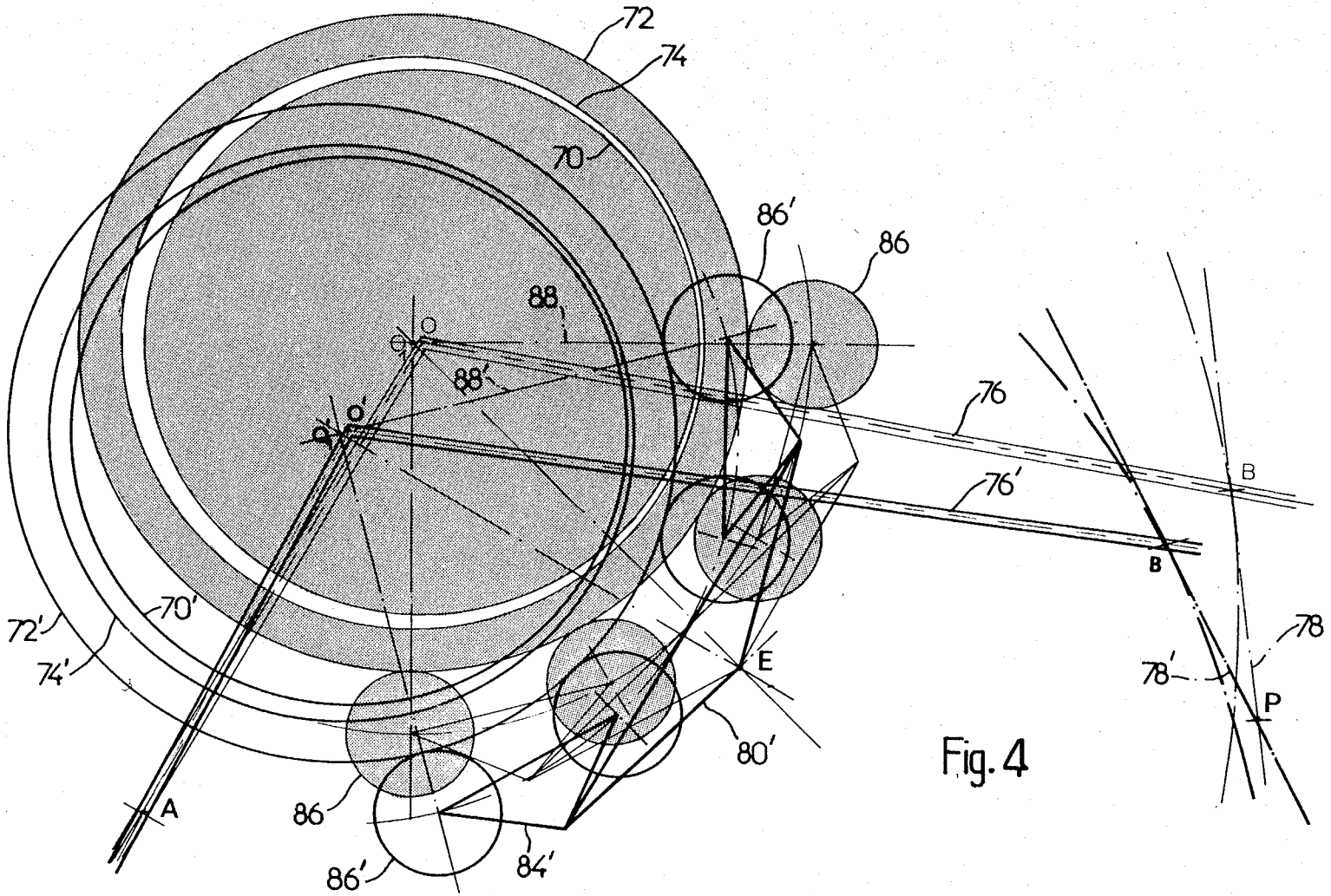
FIG. 4 is a similar diagram to FIG. 3, but showing two different positions of the press relative to the supporting structure.

By way of example, FIG. 4 shows two possible arrangements of the press shown in FIG. 3. In FIG. 4, the FIG. 3 position is shown in half-tone gray, and a second position is shown in bolder lines. The press components in the second position are given the same reference numerals as the components in the FIG. 3 position, but distinguished therefrom by the prime symbol " ' ". It can be seen that the line 88' defining the region of maximum pressure now makes an angle of 15° to the substantially horizontal line 88.

Generally speaking, the jack 78 is used to determine the force with which the wheel is thrust against the ring. It may be a hydraulic or a pneumatic jack, but advantageously, it is constituted by a resilient prestressed device or an oleo-pneumatic device (i.e. a shock-absorber type of hydraulic jack associated with a gas accumulator), thereby enabling a resilient thrust to be applied between the wheel and the ring. The material is then no longer pressed in a pressing region of constant geometry, but in a pressing region which applies constant pressure on the material.

Figure 5:
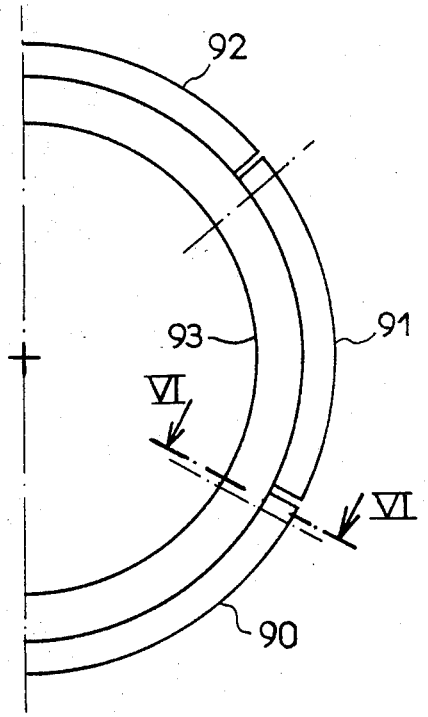
FIG. 5 is a diagram showing part of a wheel having an outer hoop.
Figure 6:
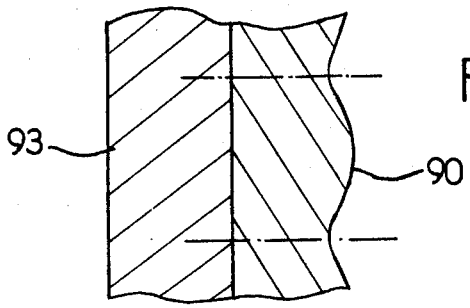
FIG. 6 is a partial cross section along a line VI-VI in FIG. 5.

The outer peripheral surface of the wheel rim may be constituted by a split hoop which is fixed to the wheel rim at one end only, with the other end being left free to avoid differential stresses. FIGS. 5 and 6 show a development of this feature in which the hoop comprises a plurality of successive segments 90, 91, 92, . . . , etc. each of which is fixed by only one of its ends to the cylindrical rim 93 of the wheel. Such a hoop makes it possible to modify the outside profile of the wheel's thrust surface, and also to vary the outside diameter of the wheel without requiring the entire wheel to be dismantled, which can be excessively complicated.

The various components of the press may be driven by means of a first hydraulic motor driving the wheel's drive shaft, and a second hydraulic motor mounted on the shaft of one of the sets of rollers 40 or 86 and driving the ring assembly via a gear wheel arrangement.

What is claimed is:

1. A continuous press, in particular for pressing beet pulp and other juice-containing materials, the press comprising:

a rotatable rimmed wheel;

a rotatable ring having an inside diameter which is greater than the outside diameter of the rimmed wheel, the ring surrounding the wheel and being eccentrically mounted relative thereto, said ring having axial end faces;

thrust means for urging the wheel rim against the inside surface of the ring in a pressing region, said pressing region having axial ends;

means for inserting material to be pressed between the wheel rim and the surrounding ring upstream from the pressing region, and means for removing pressed material downstream therefrom;

wherein the axial ends of the pressing region are closed by respective cheek plates, with each cheek plate being circular, and pressed in a substantially material-tight manner against a corresponding one of the axial end faces of the ring, said cheek plates being mounted in such a manner as to leave axial access to the space between the wheel rim and the surrounding ring at points distant from the pressing region whereby material to be pressed may be inserted, and pressed material may be removed, said cheek plates being rotatably mounted separately from said wheel and said ring about an axis which is parallel to the wheel's axis of rotation and which is fixed relative thereto, such that said cheek plates may rotate with said wheel.

2. A press according to claim 1, wherein said wheel rim has inside surfaces, and wherein said cheek plates have respective cylindrical hubs extending axially inwardly into the press, each hub having an outer cylindrical surface urged against one of said inside surfaces of the wheel rim.

3. A press according to claim 2, wherein the inside surface of the wheel rim has two annular flange portions projecting radially inwardly and engaging in respective annular grooves formed by the cylindrical surfaces of said hubs.

4. A press according to claim 3, wherein said annular flanges are constituted by the axial end walls of two annular grooves in the inside surface of the wheel rim, and wherein said cheek plate hubs have annular flanges extending radially outwardly and received in interlocking engagement in said grooves.

5. A press according to claim 2, including pressure wheels, and wherein each cheek plate hub has an inside surface which is cylindrical and engages at least one of said pressure wheels, said pressure wheels being mounted to rotate about axes which are fixed relative to the axis of rotation of said rimmed wheel and to urge the outside surfaces of the cheek plate hubs against the inside surfaces of the rim of the wheel.

6. A press according to claim 1, wherein the circular peripheral edges of said cheek plates are provided with teeth for engaging complementary drive means provided on the axial end faces of the ring.

7. A press according to claim 2, wherein the cheek plate hubs are provided with annular rims having radially outwardly directed teeth for engaging complementary drive means mounted on the wheel rim, said complementary drive means being, for example, in the form of pegs passing across annular grooves in the inside cylindrical surface of the rim.

8. A press according to claim 1, wherein said ring has a substantially cylindrical inside surface which comprises a first perforated sheet having relatively small holes, a filter cloth covering said first perforated sheet on its surface facing the rim of the wheel, and a second perforated sheet having larger holes than the first perforated sheet and pressing said cloth against said first perforated sheet, said sheets having axial edges folded over the edges of the ring and received in recesses in the axial end faces of the ring.

9. A press according to claim 8, wherein said axial edges of the first perforated sheet are welded to the end faces of the ring, while the axial edges of the second perforated sheet are releasably fastened thereto, said second perforated sheet being in the form of a plurality of segments fixed end-to-end around the ring.

10. A press according to claim 1, wherein the wheel has an axis, and including at least one rigid lever supporting said wheel axis, said rigid lever having one end articulated about a first axis parallel to the wheel axis, and having another end pivoted via a jack to a second fixed axis parallel to the wheel axis, said ring being supported via its outside surface by rollers mounted on at least one bogie which is pivoted about a third axis parallel to the wheel axis.

11. A press according to claim 1, wherein the wheel's pressure surface comprises a split hoop having only one of its ends fixed to the wheel rim periphery, or a plurality of successive hoop segments each having only one end fixed to the wheel rim periphery.

12. A press according to claim 1, wherein the axis of the cheek plates is spaced radially from the wheel axis.

13. A press according to claim 1, wherein each cheek plate has an outside diameter which is smaller than the outside diameter of the wheel.

* * * * *